US006659112B1

(12) United States Patent
Haupt

(10) Patent No.: US 6,659,112 B1
(45) Date of Patent: Dec. 9, 2003

(54) JETTED BATHTUB AIR CIRCULATION LINE CLEANING METHOD

(76) Inventor: James C. Haupt, P.O. Drawer 308, Elberta, AL (US) 36530

( * ) Notice: Subject to any disclaimer, the term of this patent is extended or adjusted under 35 U.S.C. 154(b) by 0 days.

(21) Appl. No.: 10/197,324

(22) Filed: Jul. 18, 2002

(51) Int. Cl.[7] ..... B08B 3/02; B08B 9/02

(52) U.S. Cl. ..... 134/22.12; 134/22.11; 134/22.18; 134/34

(58) Field of Search ..... 134/22.1, 22.12, 134/22.11, 22.18, 34, 42

(56) References Cited

U.S. PATENT DOCUMENTS

| | | | | | |
|---|---|---|---|---|---|
| 2,910,075 | A | | 10/1959 | Federigh et al. | 134/56 |
| 3,441,015 | A | | 4/1969 | Dutmm et al. | 128/66 |
| 4,563,781 | A | | 1/1986 | James | 4/542 |
| 4,856,125 | A | | 8/1989 | Dijkhuizen | 4/543 |
| 4,857,112 | A | * | 8/1989 | Franninge | 134/22.12 |
| 4,954,179 | A | * | 9/1990 | Franninge | 134/22.12 |
| 4,979,245 | A | | 12/1990 | Gandini | 4/542 |
| 5,012,535 | A | | 5/1991 | Klotzbach | 4/541 |
| 5,029,594 | A | | 7/1991 | Pierce, Jr. | 134/100 |
| 5,032,292 | A | | 7/1991 | Conrad | 210/764 |
| 5,109,880 | A | | 5/1992 | Booth | 134/108 |
| 5,383,239 | A | | 1/1995 | Mathis et al. | 4/541.1 |
| 5,545,335 | A | * | 8/1996 | Sween et al. | 210/748 |
| 5,587,023 | A | * | 12/1996 | Booth | 134/32 |
| 5,694,957 | A | | 12/1997 | Lee, Jr. | 134/169 C |
| 5,862,545 | A | | 1/1999 | Mathis et al. | 4/662 |

* cited by examiner

*Primary Examiner*—Randy Gulakowski
*Assistant Examiner*—Saeed Chaudhry
(74) *Attorney, Agent, or Firm*—Peter Loffler

(57) ABSTRACT

A method for cleaning the air circulation line of a jetted bathtub uses a conduit that has one end received within water in the tub and the opposing end received within the air intake nozzle of the tub. Upon activation of the motor, water circulates through the air circulation line in order to clean the line, the water being picked up from the tub via the conduit. If desired, a cleaning solution can be placed into the water or into a housing that is fluid flow connected in series with the conduit, in order to enhance the cleaning process.

4 Claims, 2 Drawing Sheets

JETTED BATHTUB AIR CIRCULATION LINE CLEANING METHOD

BACKGROUND OF THE INVENTION

1. Field of the Invention

The present invention relates to a method to routinely clean the air circulation lines of a typical home jetted bathtub.

2. Background of the Prior Art

As the costs of such systems have come down in recent years, home jetted bathtubs and their close cousins, the hot tubs, are a regular fixture in many homes. Such bathtubs, in addition to performing like standard tubs, have a plurality of jet nozzles located along the inside of the tub in spaced apart fashion, and upon activation of a motor, dispense a jet stream through the jet nozzles, which jet stream is a combination of water taken from one or more appropriate intake nozzles within the tub, and air taken from an air intake nozzle located on the tub and above the expected water fill line within the tub. The water and air is circulated via the motor through water and air circulation lines respectively and out through the jet nozzles in a combined stream of water and air. The jet stream so emitted is very soothing and relaxing to the user of the tub.

These tubs, like any product, need to be cleaned, and due to the fact that the jetted bathtub is a water holding product, the cleaning schedule needs to be frequent. The inside of the tub is cleaned in normal fashion. The water circulation lines that move water from the tub's water intake nozzles and back into the tub through the jet nozzles, via the motor, move a large amount of water during a typical bathing session. The water picks up dirt deposited by the user (after all, one reason for using the tub is to get cleaned) as well as from the atmosphere, and deposits the dirt along with some of the minerals found in the water supply within the water circulation lines. The deposited dirt, coupled with the water that remains in the tub's water circulation lines, after bathtub use can cause the formation of mold and other bacteria. Therefore, special attention is required in keeping these water circulation lines clean.

The water circulation lines are within the internal subsystem of the bathtub, and therefore, are inaccessible to the homeowner. Accordingly, special devices have been proposed that assist the user of the bathtub in flushing and keeping these water circulation lines clean. Such devices, which range from relatively simple devices to relatively elaborate devices, work with varying degrees of efficiency in keeping the water circulation lines clean between tub uses.

While much attention is given to the cleaning of the water circulation lines within the jetted bathtub, scant little attention is given to the air circulation lines of the tub. The air circulation lines also take in dirt from the atmosphere. As such lines are located within a tub which is full of water (usually hot water which gives off steam), when these lines are active, a large amount of moisture is pulled into these lines. The dirt pulled in from the atmosphere, coupled with the moisture pulled into the air circulation lines, if left unchecked, will also cause the development of mold and other bacteria therein.

Therefore, there exists a need in the art for a system that cleans the air circulation lines of a jetted bathtub, thereby helping prevent the buildup of dirt as well as the growth of mold, bacteria, and other contaminants within the air circulation lines. Such a system must be of relatively simple design and construction and must be relatively easy to implement, use, and maintain. Such a system must be able to properly clean the air circulation lines in a relatively short amount of time without the need for special tools.

SUMMARY OF THE INVENTION

The jetted bathtub air circulation line cleaning method of the present invention addresses the aforementioned needs in the art. Specifically, the jetted bathtub air circulation line cleaning method cleans the air circulation lines of a jetted bathtub, which helps prevent the buildup of dirt and the growth of mold, bacteria, and other contaminants within the air lines. The present invention is of relatively simple design and construction and is relatively easy to implement, use, and maintain and is able to properly clean the air circulation lines in a relatively short amount of time without the need for special tools.

The jetted bathtub air circulation line cleaning method of the present invention is comprised of the steps of filling the tub with water in normal fashion. A conduit, having a first end and a second end, is provided with the first end of the conduit being placed into the air intake nozzle and the second end of the conduit being placed into the water. The motor is activated so that the motor pulls the water from the jetted bathtub, through the conduit, into the air intake nozzle, and into the air circulation lines. The conduit may be made from flexible material. A cleaning solution may be placed directly into the water or a housing can be provided and a cleaning solution placed into the housing. The housing is fluid flow connected to the conduit so that a portion of the cleaning solution is absorbed by the water as the water circulates through the conduit.

BRIEF DESCRIPTION OF THE DRAWINGS

Similar reference numerals refer to similar parts throughout the several views of the drawings.

DESCRIPTION OF THE PREFERRED EMBODIMENT

Figure 1:
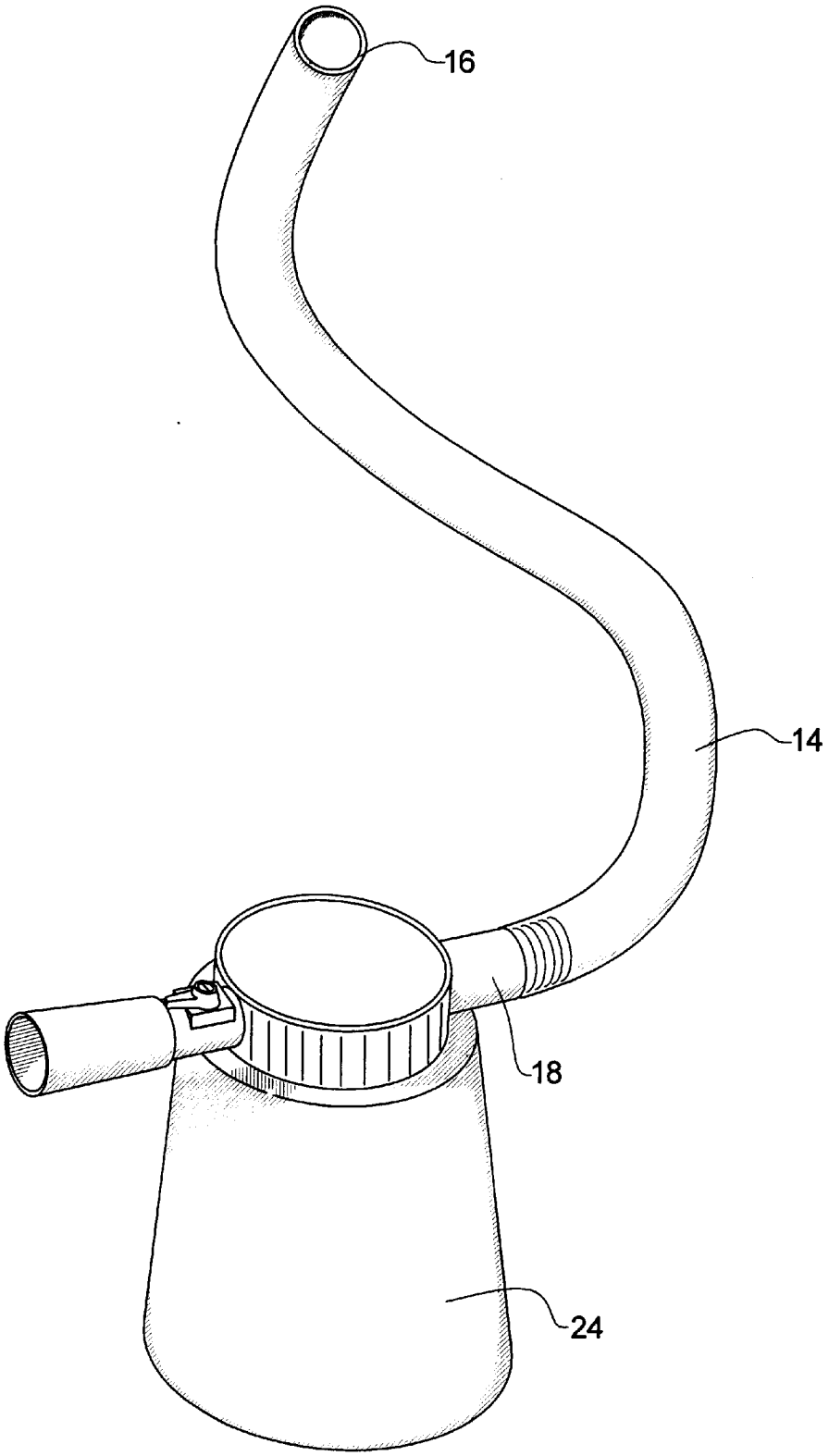
FIG. 1 is a perspective view of the jetted bathtub air circulation line system that is used with the method of the present invention.
Figure 2:
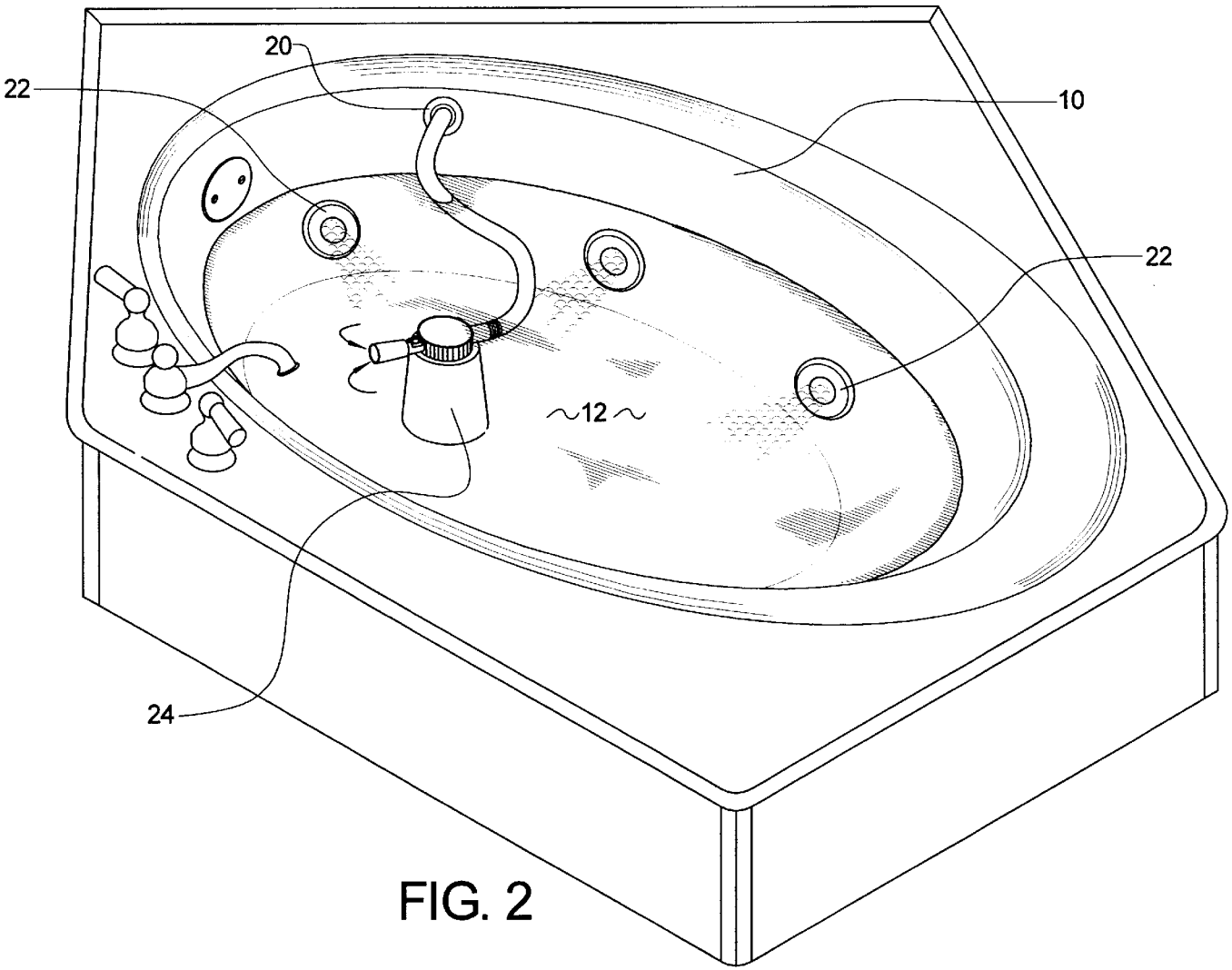
FIG. 2 is an environmental view of the jetted bathtub air circulation line cleaning method being implemented.

Referring now to the drawings, it is seen that the jetted bathtub air circulation line cleaning method of the present invention is comprised of the steps of filling the bathtub 10 with water 12 in normal fashion. A conduit 14, having a first end 16 and a second end 18, is provided. Advantageously, the conduit 14 is flexible and is made from an appropriate durable material such as rubber or neoprene. The first end 16 of the conduit 14 is placed into the air intake nozzle 20 of the tub and the second end 18 of the conduit 14 is placed into the water 12 preferably but not necessarily below the water 12. The conduit 14 is dimensioned so that it snugly fits within the air intake nozzle. The tub's motor (not illustrated) is activated so that the motor pulls the water 12 from the jetted bathtub 10, through the conduit 14, into the air intake nozzle 20, and into the air circulation line. Thereafter, the water 12 is discharged back into the tub 10 through the jet nozzle 22 of the tub 10. The water 12 passing through the air circulation line cleans the air circulation line.

A cleaning solution, such as an appropriate soap or bleach, the particular cleaning solution being dependent on the interior surface of the tub 10 and the material from which the air circulation line is made so as not to cause damage to either, may be placed into the water 12 at an appropriate concentration. Alternately, a housing 24 can be provided and the cleaning solution placed into the housing 24. The housing 24, which is of any standard design known in the art and which may have a "dialer" thereon for controlling the amount of solution released per the given flow of water through the housing 24, is fluid flow connected to the conduit 14 so that a portion of the cleaning solution is absorbed by the water 12 as the water 12 circulates through the conduit 14.

If the jetted bathtub 10 has more than one air intake nozzle 20, then a separate conduit 14 must be received in each air intake nozzle 20 with the opposing end 18 of the conduit 14 placed within the water 12. This is necessary not only because the air circulation line coupled to each nozzle 20 must be cleaned, but if less than all nozzles 20 are engaged by a conduit 14, then the motor may only pull air through the unengaged nozzles 20 and may not pull any water 12 through the engaged nozzles 20, as the unengaged nozzles 20 have less resistance for drawing air thereinto relative to the resistance of a nozzle 20 attempting to draw water 12 thereinto.

The motor is kept operational until the air circulation line is properly cleaned. Thereafter, the tub 10 is drained and rinsed if needed. If desired, the motor can be activated for a few seconds thereafter, in order to allow any residual moisture within the air circulation line to be expelled therefrom. If necessary (if the air circulation line is particularly dirty), the tub 10 can be refilled with water 12 and the process repeated.

While the invention has been particularly shown and described with reference to an embodiment thereof, it will be appreciated by those skilled in the art that various changes in form and detail may be made without departing from the spirit and scope of the invention.

I claim:

1. A cleaning method for a jetted bathtub, the jetted bathtub having an air intake nozzle that leads to an air circulation line and a motor for circulating air through the air circulation line, the method comprising the steps of:

filling the jetted bathtub with water;

providing a conduit having a first end and a second end;

placing the first end of the conduit into the air intake nozzle and the second end of the conduit into the water; and activating the motor so that the motor pulls the water from the jetted bathtub, through the conduit, into the air intake, and into the air circulation line.

2. The cleaning method as in claim 1 wherein the conduit is flexible.

3. The cleaning method as in claim 1 further comprising the step of placing a cleaning solution into the water.

4. The cleaning method as in claim 1 further comprising the steps of:

providing a housing;

placing a cleaning solution into the housing; and fluid flow attaching the housing to the conduit so that a portion of the cleaning solution is absorbed by the water as the water circulates through the conduit.

* * * * *